US008408472B2

(12) United States Patent
Yang

(10) Patent No.: US 8,408,472 B2
(45) Date of Patent: Apr. 2, 2013

(54) EAS TAG WITH ARTICULATED BODY AND ATTACHING ELEMENT

(76) Inventor: Xiao Hui Yang, Los Altos, CA (US)

( * ) Notice: Subject to any disclaimer, the term of this patent is extended or adjusted under 35 U.S.C. 154(b) by 62 days.

(21) Appl. No.: 13/204,575

(22) Filed: Aug. 5, 2011

(65) Prior Publication Data

US 2013/0032637 A1 Feb. 7, 2013

(51) Int. Cl.
*G08B 13/14* (2006.01)

(52) U.S. Cl. ..... 235/487; 340/572.8; 235/492

(58) Field of Classification Search ..... 235/487, 235/492; 340/572.1–572.9
See application file for complete search history.

(56) References Cited

U.S. PATENT DOCUMENTS

| | | | |
|---|---|---|---|
| 3,708,835 | A | 1/1973 | Bienz |
| 4,196,424 | A | 4/1980 | Williamson |
| 4,263,697 | A | 4/1981 | Speedie |
| 4,441,233 | A | 4/1984 | Swift |
| 4,506,415 | A | 3/1985 | Swift |
| 5,337,503 | A | 8/1994 | Goby |
| 5,524,463 | A | 6/1996 | Schenkel et al. |
| 5,568,951 | A | 10/1996 | Morgan |
| 5,570,080 | A | 10/1996 | Inoue |
| 5,627,520 | A | 5/1997 | Grubbs et al. |
| 5,717,382 | A | 2/1998 | Cooper |
| 5,856,782 | A | 1/1999 | Sasagawa et al. |
| 5,945,909 | A | 8/1999 | Kolton |
| 5,949,336 | A | 9/1999 | Deschenes et al. |
| 5,959,532 | A | 9/1999 | Fujiuchi |
| 5,969,613 | A | 10/1999 | Yeager et al. |
| 5,995,003 | A | 11/1999 | Rogers |
| 6,025,781 | A | 2/2000 | Deschenes |
| 6,052,876 | A | 4/2000 | Hogan et al. |
| 6,188,320 | B1 | 2/2001 | Kolton et al. |
| 6,326,890 | B1 | 12/2001 | Costa |
| 6,535,130 | B2 | 3/2003 | Nguyen et al. |
| 6,624,753 | B2 | 9/2003 | Elston |
| 6,724,311 | B1 | 4/2004 | Kolton et al. |
| 6,731,212 | B2 | 5/2004 | Hirose |
| D493,739 | S | 8/2004 | Copen |
| D494,487 | S | 8/2004 | Sayegh |
| D502,419 | S | 3/2005 | Copen |
| D503,900 | S | 4/2005 | Sayegh |
| D504,634 | S | 5/2005 | Sayegh |
| D504,839 | S | 5/2005 | Sayegh |
| D505,349 | S | 5/2005 | Sayegh |
| 6,933,847 | B2 | 8/2005 | Feibelman et al. |
| D509,454 | S | 9/2005 | Sayeh |
| 7,005,989 | B2 | 2/2006 | Benoit et al. |
| 7,062,823 | B2 | 6/2006 | Copen |

(Continued)

*Primary Examiner* — Thien M Le
*Assistant Examiner* — Christle Marshall
(74) *Attorney, Agent, or Firm* — Robert R. Waters; Brian W. Foxworthy; J. Michael Wells

(57) ABSTRACT

An electronic surveillance article (EAS) tag has an articulated body, or housing, having an articulating joint joining two portions, or pods. In one embodiment a first portion, or sensor pod, encloses EAS elements and a second portion, or retention pod, contains a retention mechanism. In one embodiment, the retention pod and sensor pod are connected by a swivel joint. In one embodiment the retention pod encloses a ball clutch. An aperture in the retention pod gives access to an aperture in the ball clutch. A shaft on an attaching element inserts into the clutch to attach the tag to an object. In one embodiment, the attaching element is a lanyard having one end terminating in a shaft and the other end terminating in a connector for forming a loop in the lanyard. Other attaching elements may be used.

25 Claims, 6 Drawing Sheets

U.S. PATENT DOCUMENTS

| | | | | |
|---|---|---|---|---|
| 7,129,841 | B2 | 10/2006 | Feibelman | |
| 7,148,805 | B2 | 12/2006 | Hogan | |
| 7,183,914 | B2 | 2/2007 | Norman et al. | |
| 7,227,467 | B2 | 6/2007 | Feibelman | |
| 7,249,401 | B2 | 7/2007 | Copen | |
| 7,286,055 | B2 | 10/2007 | Girvin et al. | |
| 7,342,495 | B2 | 3/2008 | Sayegh | |
| D566,598 | S | 4/2008 | Sayegh | |
| D567,128 | S | 4/2008 | Sayegh | |
| D578,030 | S | 10/2008 | Yang | |
| 7,456,741 | B2 * | 11/2008 | Norman et al. | 340/568.1 |
| 7,518,521 | B2 | 4/2009 | Feibelman et al. | |
| 7,595,733 | B2 | 9/2009 | Spagna | |
| 7,626,501 | B2 | 12/2009 | Feibelman | |
| 7,671,741 | B2 | 3/2010 | Lax et al. | |
| 7,724,146 | B2 | 5/2010 | Nguyen et al. | |
| 7,808,390 | B2 | 10/2010 | Sayegh | |
| 7,969,310 | B2 | 6/2011 | Sayegh | |
| 2010/0308998 | A1 | 12/2010 | Hesch, Jr. et al. | |
| 2010/0315237 | A1 | 12/2010 | Yang | |

* cited by examiner

EAS TAG WITH ARTICULATED BODY AND ATTACHING ELEMENT

FIELD OF THE INVENTION

This application relates to the field of electronic article surveillance (EAS) and security. In particular, this application relates to EAS tags that use attaching elements that have a shaft that inserts into a retention mechanism, such as a clutch, to attach the tag to an object to be protected.

BACKGROUND OF THE INVENTION

EAS tags have been used for many years as a means of deterring retail shoplifting in clothing stores, electronic stores, and a myriad of other retail establishments. Generally speaking, an EAS system will consist of a durable and reliable, yet small, sensor tag which is affixed to the article to be detected in such a way that it cannot be easily removed by a customer in the store. Usually, the system depends on the feature that the attachment mechanism is constructed such that it can only be removed by the use of a specialized tool which is only in possession of the store personnel at the checkout register or exit port for the establishment. In the event that an EAS tag is not removed from a protected article prior to exiting the store, an alarm or other signal is activated.

In order for an EAS system to be reliable, the tag must be effective in that a shoplifter will be unable to remove it within the store. In some systems, the tag is encapsulated with an ink cartridge which will open and permanently destroy the protected item and make a considerable mess in the process. In other systems, the tag is attached with an attaching element that will cause destruction of the article if it is pulled or ripped from the article. In addition, the tag attaching element must be rigid enough to withstand efforts to crack it open within the store. In short, the EAS tag must be called upon to perform reliably amid challenges by the most clever and aggressive of shoplifters.

Although an assortment of attaching elements are available in the prior art, one of the more common and more successful attaching elements consists of a tack which is used to physically pin the protected article to the EAS tag base. The tack has a shaft and cap. The shaft inserts through the protected article into a tension mechanism in the tag body, and the cap retains the tag on the protected article. The tag base is usually constructed of a hard and durable plastic and is generally in the neighborhood of three inches long. A variation on the tack within the prior art is a lanyard ending in a pin, or shaft. One end of the lanyard is fixed to the tag body while the other end terminates in a pin shaft. The lanyard wraps around a portion of the object to be protected and the pin shaft inserts into a retention mechanism in the tag body.

The tag serves as a housing for an electronic signal generation means secured within the housing, which is designed to be immune to tampering. The security system is further characterized by one or more system receiver/transmitters which generate an interrogation zone in the general vicinity of the exit door to the retail establishment. The interrogation zone is usually defined by the installation of one or more transmitters adjacent to the exit doorway. When an EAS tag is moved into or through the surveillance zone, an electronic transmitter within the EAS tag's electronic signal generation means will cause a signal to be generated which will be received by a system receiver to indicate that an unauthorized presence of a tagged article has been detected within the interrogation zone. Accordingly, alarms may sound or personnel may otherwise be alerted to the event such that the shoplifting can be thwarted at the exit port of the retail establishment.

In some embodiments of EAS tags, the electronic signal transmitter may be a passive EAS element. A passive EAS element is energized by the interrogation field when in the field and generates a signal with this energy. One type of passive EAS element is a ferrite core with a conductive coil wrapped around it. When in the presence of the interrogation field, the core and coil have energy stored in them by the field. When the field is terminated, the energy from the core and coil dissipates, and the element generates a signal in the process. The broader EAS system detects this signal and therefore detects the tag in the interrogation field. Other passive EAS elements include magneto-restrictive elements.

In some embodiments of EAS tags, the electronic signal transmitter may be one element of several electronic elements in an active electronics package with an onboard power supply such as a battery. The electronic signal transmitter may be a radio frequency transmitter operating in conjunction with a microprocessor and the electronics may receive signals as well as transmitting them. Other forms of wireless communication, such as optical communication, may also be enabled with the appropriate electronics in the tag. Optical wireless communication may comprise infrared communication ports that receive infrared signals and light emitting diodes that transmit infrared signals.

Most of the tack-based or lanyard-based EAS tags are constructed such that the tags which are removed at the checkout register may be re-attached to other merchandise for re-use. In general, the shaft attaching element of the EAS tag may only be removed through the operation of a specialized detaching mechanism by store personnel. A common detaching mechanism is a magnetic detacher. These detachers use a magnetic force to release the pin or tack shaft from a retention mechanism. There are several mechanisms within the prior art that can be released by the application of a sufficiently strong magnet.

RELATED ART

U.S. Pat. No. 5,856,782 by Sasagawa, et al. is for a "Portable wire loop anti theft alarm with magnetic unlocking" In Sasagawa et al., a portable anti-theft monitor comprises a case; a detection conductive wire led out of said case, having a loop portion; an engaging member provided in said case so as to freely get it in and out, for engaging by catching the loop portion of said detection conductive wire in a state in which it has been pressed in said case; and a locking member for locking said engaging member in the state in which said engaging member has been pressed into said case, and for being attracted by a magnet to be moved in the unlocking direction.

U.S. Pat. No. 5,570,080 by Inoue, et al. is for a "Theft prevention tab device having alarm mechanism housed therein." The tag device for theft prevention of Inoue, et al. includes a tag body, a fastener for fastening the tag body to a merchandise, a wire extending from the tag body for fastening the tag body to a fixed member, a detector for detecting that the tag body has been detached from the merchandise, and an alarm that activates if the detector detects that the tag body has been detached from the merchandise.

U.S. Pat. No. 7,183,914 by Norman, et al. is for a "Hang tag with swivel attachment." A hang tag provides for the accommodation of electronic article surveillance (EAS) marker. The hang tag includes a housing for supporting the EAS marker therein. A securement head is provided for accommodating a securement strap for coupling the housing to an article which is to be protected. The head is coupled to the housing in such a fashion that it permits continuous rotation with respect to the housing to thwart and attempt to improperly sever the securement strap from the article.

U.S. Pat. No. 6,933,847 by Feibelman is for an "Anti-theft tag." The anti-theft security tag of Feibelman includes an engagement member having a first and second end securable within a housing for attachment to an article. The housing supports an electronic article surveillance marker and may include one or more channels for receiving and securing at least one crimping sleeve. The at least one crimping sleeve is sized to receive one end of the engagement member. A slot is disposed within the housing in alignment with the at least one crimping sleeve, and is sized to receive a crimping tool to crimp the sleeve and secure the wire to the article within the housing.

SUMMARY

An electronic surveillance article (EAS) tag has an articulated body, or housing, having an articulating joint joining two portions, or pods. In one embodiment, a first portion, or sensor pod, encloses an EAS element and a second portion, or retention pod, contains a retention mechanism such as a clutch. In one embodiment, the retention pod and sensor pod are connected by a swivel joint. In one embodiment the retention pod encloses a ball clutch. An aperture in the retention pod gives access to an aperture in the ball clutch. The ball clutch is comprised of a tapered cup having an aperture at the bottom of its bowl section and is open at its other end. A spindle fits into this tapered cup and has a hollow axis through it with three apertures surrounding it and passing through its sides to the hollow axis. A ball rests in each of the apertures in the side of the spindle and a spring biases the spindle up into the tapered cup. A cap encloses the open end of the tapered cup and contains the spindle, spring and balls within the tapered cup. When a pin is inserted into the three ball clutch it can not be withdrawn because the tapered cup and three balls develop a wedging affect on the shaft of the pin, or tack. The spindle is at least partially made from a magnetically attractable material and application of a magnet to the cap of the three ball clutch pulls the spindle back against the spring which brings the spindle and its balls into a wider area of the tapered cup. This gives some play to the balls and creates space between them and the shaft of the pin or tack. This additional space allows the shaft to be withdrawn. In one embodiment of the tag with articulated housing, the pin shaft is on the end of an elongated lanyard which has a connector, such as an eyelet, at its opposing end. The shaft may be inserted through the connector to form a loop to capture an object to be protected. The shaft of the pin end of the lanyard is then inserted into the aperture of the retention pod to insert into the retention mechanism, for example, a three ball clutch as just described. Once the lanyard is looped around an object and the pin is inserted into the ball clutch, the retention mechanism must be released to allow the withdrawing of the tack and the removal of the tag from the object. In some embodiments this release may be accomplished by application of a magnet to the retention mechanism.

The sensor pod may enclose an electronic element, or elements. In one embodiment the sensor pod encloses a passive EAS element. A common passive EAS element is a ferrite core and coil. The sensor pod may also enclose other passive elements, such as a magneto-restrictive resonator. Some embodiments of the EAS tag with articulated body may enclose active electronic elements. These active electronics may include an onboard power supply, a microprocessor, and wireless communication elements.

BRIEF DESCRIPTIONS OF THE DRAWINGS

DETAILED DESCRIPTIONS OF THE EMBODIMENTS

Figure 1:
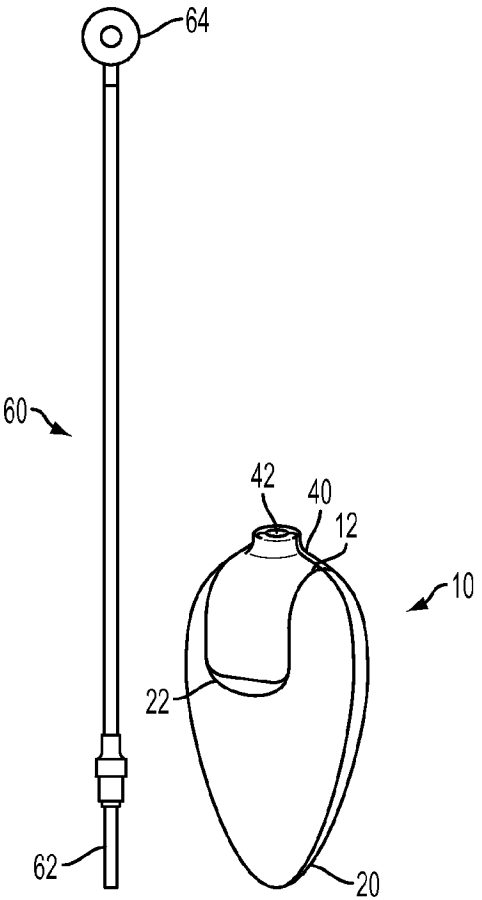
FIG. 1 is a perspective view of an EAS tag with an articulated body with a lanyard along side as an attaching element.

FIG. 1 is a perspective view of an embodiment of the EAS tag 10 with articulated body. The articulated body is comprised of two portions, sensor pod 20 and retention pod 40. Sensor pod 20 and retention pod 40 are joined at joint 12 which allows movement between sensor pod 20 and retention pod 40. In the embodiment of FIG. 1, joint 12 is a pivoting joint about which they may turn with respect to each other, and sensor pod 20 has a recess 22 for accommodating retention pod 40. Retention pod 40 has an aperture 42 in it which gives access to the interior of retention pod 40 where a retention mechanism is enclosed.

Lanyard 60 along side of EAS tag 10 has a pin, or shaft, end 62 at one end and an connector 64 at the other end for forming a loop. In the embodiment shown in FIG. 1 connector 64 is an eyelet sized large enough that the other end 62 may pass through it to form a loop. The pin end 62 of lanyard 60 may be inserted into aperture 42 in retention pod 40 to be engaged in a retention mechanism housed therein.

Figure 2:
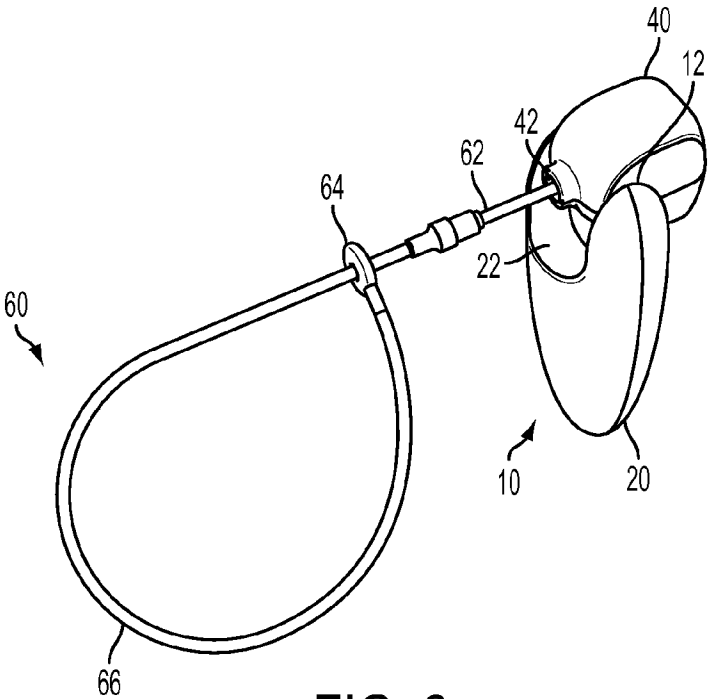
FIG. 2 is a front perspective view of an EAS tag with the body articulated.

FIG. 2 is a front perspective view of EAS tag 10 with retention pod 40 turned 90 degrees from its position in FIG. 1. Pin 62 and first end of lanyard 60 has been passed through connector 64 of second end of lanyard 60 to form lanyard 60 into a loop 66. Pin end 62 is positioned to been inserted into retention pod 40. Loop 66 is used to attach EAS tag 10 to an object to be protected. Loop 66 may pass around a handle or similar feature of the object or pass through an aperture in the object.

Figure 3:
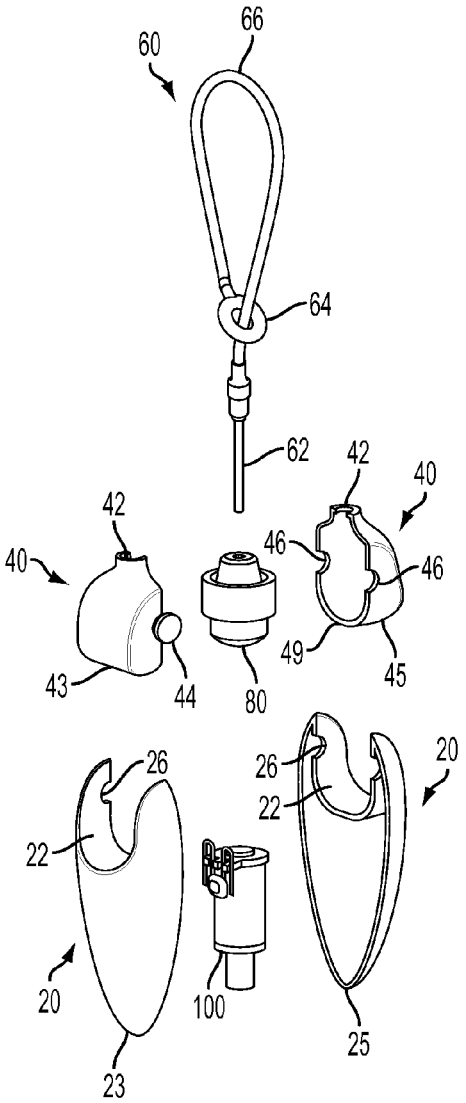
FIG. 3 is an exploded perspective view of the EAS tag with an articulated body.

FIG. 3 is in exploded perspective view of EAS tag 10 with articulated body. Sensor pod 20 and retention pod 40 are separated from each other and each are split into two separate clam shell portions. Sensor pod 20 is separated into portions 23 and 25, and retention pod 40 is separated into portions 43 and 45. The two portions, 23 and 25, of sensor pod 20 are symmetrical and have a hollow interior enclosing an EAS sensor 100. In the embodiment of retention pod 40 shown in FIG. 3 a first portion 43 carries a set of swivels 44 located on opposite sides. The second portion 45 has yokes 46 for accommodating swivels 44 when portions 43 and 45 are assembled. Sensor housing 20 similarly has yokes 26 for closing over swivels 44 on assembled retention pod 40 when portion 23 and 25 are assembled to form sensor housing 20.

Sensor housing 20 is shaped to provide recess 22 to accommodate retention pod 40. Retention pod 40 encloses retention mechanism 80 which in the embodiment shown in FIG. 3 is a ball clutch. When portions 43 and 45 of retention pod 40 are assembled, aperture 42 is formed, allowing access to retention mechanism 80.

Figure 4:
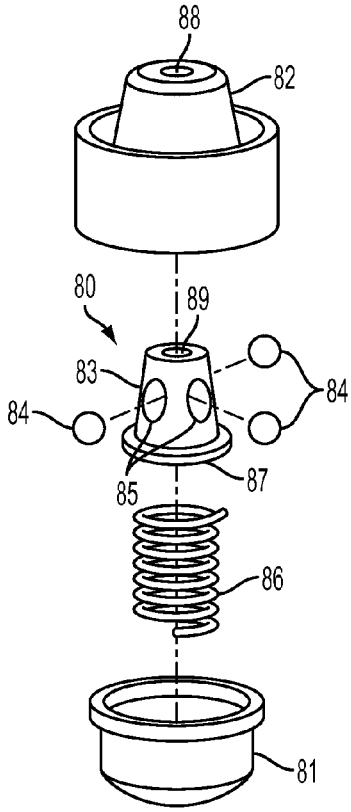
FIG. 4 is an exploded perspective view of a ball clutch.

FIG. 4 shows an exploded view of one embodiment of retention mechanism 80 as a ball clutch mechanism. Retention mechanism 80 is comprised of cap 81, cup 82, spindle 83, balls 84, and spindle spring 86. When retention mechanism 80 is assembled, cap 81 contains the other elements of ball clutch mechanism 80 in cup 82. Cup 82 is slightly conical in shape and open at the large end of the cone. It is closed at the smaller end of the cone but has an aperture 88 through the closed end. Spindle 83 is generally cylindrical and sized and shaped to fit into cup 82, is hollow along its axis, and has ball apertures 85, typically three, from its outer surface to its hollow central axis. Aperture 89 in spindle 83 is the top of the hollow axis. Spindle 83 also has a spring seat 87 around its circumference on the end opposing cup 82. Spring 86 sets on spring seat 87. Balls 84 are located in ball apertures 85 and the assembly of spindle 83 and balls 84 rest in cup 82. Aperture 88 in cup 80 aligns with aperture 42 in retention pod 40 when retention pod 40 is assembled with retention mechanism 80 inside. Clutch cap 81 rests on bottom 49 of retention pod 40.

Referring now to FIGS. 1, 3, and 4, when lanyard 60 is looped and shaft 62 inserted into EAS tag 10, shaft 62 inserts through shaft aperture 42 and into cup 82 and spindle 83. This pushes spindle 83 down slightly along with balls 84 around the periphery of spindle 83. Balls 84 encircle shaft 62 and spindle spring 86 biases spindle 83 into cup 82 to maintain contact between cup 82, balls 84, and shaft 62 so that if an attempt is made to withdraw shaft 62, balls 84, shaft 62, and conical cup 82 create a wedging action preventing shaft 62 from being withdrawn. Spindle 83 is made at least partially of a magnetically attractable material. Spring 86 generally biases spindle 83 into cup 82. To release shaft 62 from retention mechanism 80, a magnet is applied to the back of retention pod 40. The magnetically attractable spindle 83 is pulled partially from cup 82, overcoming spring 86, and balls 84 are moved into an area of cup 82 where space is available between balls 84 and shaft 62. This allows shaft 62 to be withdrawn from retention mechanism 80. Shaft 62 may be withdrawn from retention mechanism 80 and retention pod 40. Other types of retention mechanisms may also be employed in other embodiments of EAS tag 10.

Figure 5:
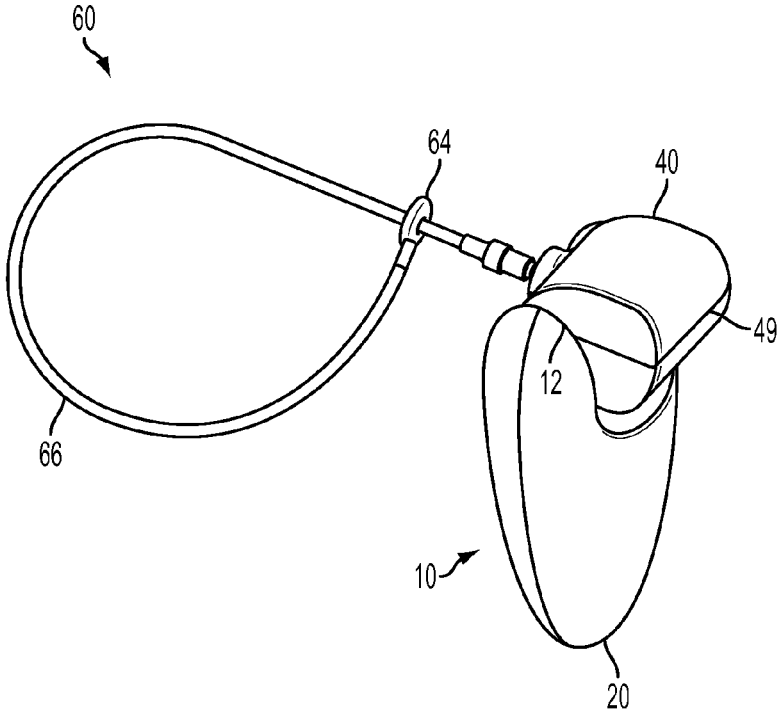
FIG. 5 is a back perspective view of the EAS tag with the body articulated.

FIG. 5 is a back perspective view of the EAS tag 10 with the body articulated. Bottom 49 of retention pod 40 is exposed in this position. Referring to FIGS. 3 and 4, clutch cap 81 rests against bottom 49 of retention pod 40. Movement of spindle 83 toward bottom 49 of retention pod 40 allows the removal of an attaching member, which in this embodiment is lanyard 60, from retention mechanism 80 and retention pod 40.

Figure 6:
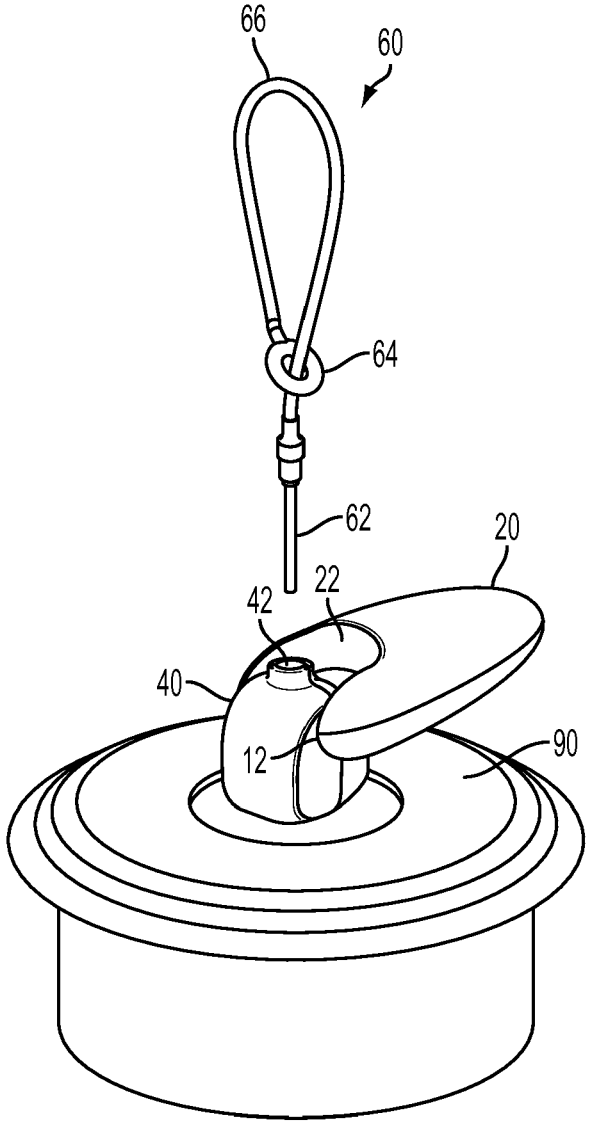
FIG. 6 is a perspective view of an EAS tag with articulated body being released by a detacher.

FIG. 6 is a perspective view of an EAS tag 10 with articulated body being released by a detacher 90. Retention pod 40 is articulated with respect to sensor pod 20 to expose bottom 49. Bottom 49 is placed on detacher 90. For embodiments of EAS tag 10 using a ball clutch as retention mechanism 80, detacher 90 is capable of creating a magnetic force sufficient to move spindle 83 partially from cup 82, allowing shaft 62 of an attaching element to be withdrawn. Separation of the attaching element from the rest of EAS tag 10 allows the removal of EAS tag 10 from an object to be protected. In the embodiment shown in FIG. 6, detacher 90 comprises a permanent magnet. Other embodiments may employ an electromagnet.

Figure 7:
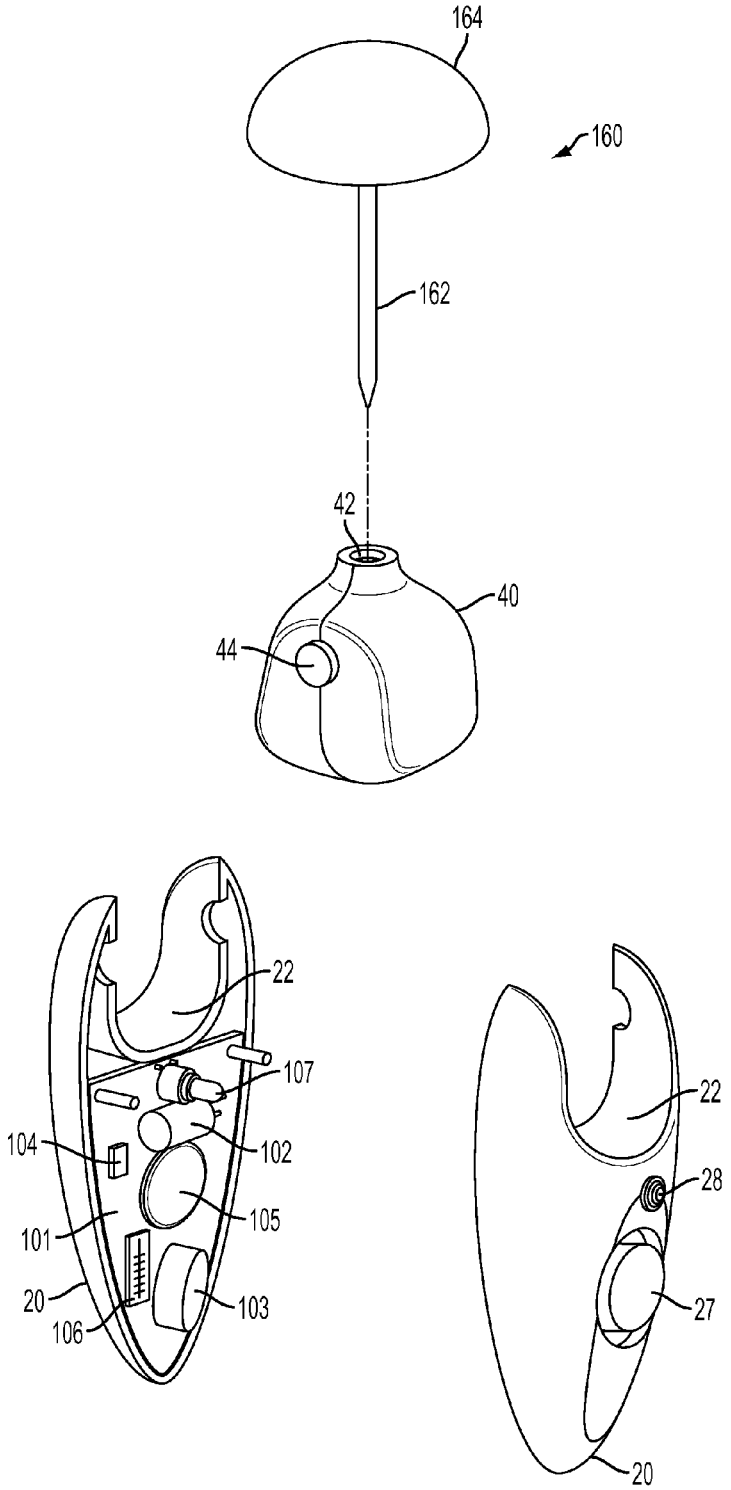
FIG. 7 is an exploded perspective view of an EAS tag with articulated body with a tack as the attaching element.

FIG. 7 is an exploded perspective view of an EAS tag with articulated body with a tack as the attaching element. Tack 160 has a shaft 162 with cap 164 on one end of shaft 162. Shaft 162 of tack 160 pierces or passes through an object to be protected and inserts through aperture 42 into a retention mechanism in retention pod 40. This retention mechanism may be any of several retention mechanisms for retaining a shaft including the three ball clutch discussed more specifically above.

In the embodiment of EAS tag 10 shown in FIG. 7, active EAS elements are contained within sensor pod 20. Circuit board 101 in sensor pod 20 provides a substrate for the mounting of active EAS elements. Onboard power supply 102 provides power for the active elements and may be a battery or other suitable power supply. Microprocessor 103 is capable of storing information and controlling and interacting with other EAS elements such motion detector 104, sound generator 105, and wireless communication elements. The wireless communication elements may include radio frequency transmitting and receiving circuitry 106 or an infrared communication port 107.

Sensor pod 20 may have features to facilitate the activities of the active EAS elements. Sound aperture 27 facilitates the transmission of sounds created by sound generator 105. Optical aperture 28 allows the transmission and receipt of optical signals such as used in infrared wireless communication systems.

Figure 8:
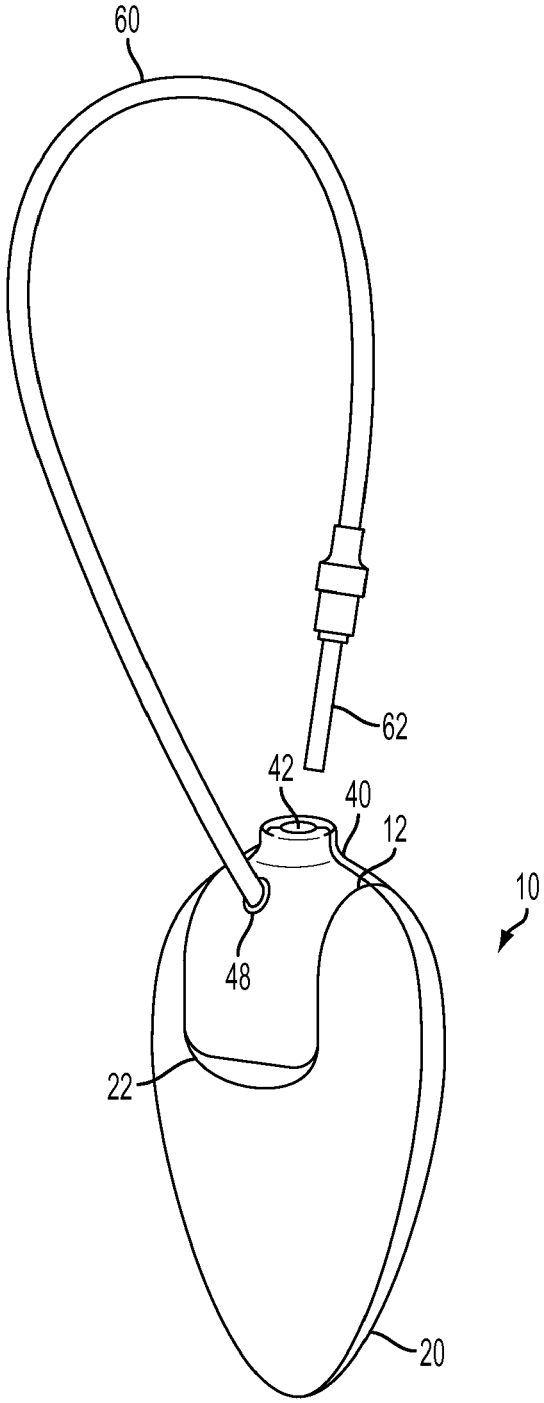
FIG. 8 is a perspective view of an EAS tag with articulated body with a lanyard with one end permanently anchored.

FIG. 8 is a perspective view of an EAS tag 10 with articulated body with a lanyard 60 with one end permanently anchored. In the embodiment shown in FIG. 8, lanyard 60 has one end terminating in shaft 62 and the other end passing through lanyard aperture 48 into the interior of retention pod 40 where it is permanently, or semi-permanently anchored. Lanyard 60 is passed around or through an object to be protected and shaft 62 is inserted through aperture 42 into the interior of retention pod 40 to be engaged by a retention mechanism housed therein.

It is to be understood that the embodiments and claims are not limited in application to the details of construction and arrangement of the components set forth in the description and illustrated in the drawings. Rather, the description and the drawings provide examples of the embodiments envisioned, but the claims are not limited to any particular embodiment or a preferred embodiment disclosed and/or identified in the specification. The drawing figures are for illustrative purposes only, and merely provide practical examples of the invention disclosed herein. Therefore, the drawing figures should not be viewed as restricting the scope of the claims to what is depicted.

The embodiments and claims disclosed herein are further capable of other embodiments and of being practiced and carried out in various ways, including various combinations and sub-combinations of the features described above but that may not have been explicitly disclosed in specific combinations and sub-combinations. As examples, a lanyard is shown and discussed as an attaching element when a tack with shaft and cap could also be used as an attaching element and a core and coil element is shown and discussed as a passive EAS element when other passive elements are known such as magneto-restrictive elements. Further, other clutches could be used as well. Accordingly, those skilled in the art will appreciate that the conception upon which the embodiments and claims are based may be readily utilized as a basis for the design of other structures, methods, and systems. In addition, it is to be understood that the phraseology and terminology employed herein are for the purposes of description and should not be regarded as limiting the claims.

I claim:

1. An electronic article surveillance tag comprising:

a first pod containing electronic article surveillance electronics;

a second pod containing a retention mechanism, said second pod having an aperture allowing access to said retention mechanism; and, an attaching element for attaching said second pod to an article to be protected, said attaching element having a shaft sized to be inserted through said aperture in said second pod into said retention mechanism to be retained by said retention mechanism;

said first pod and said second pod being joined together by an articulating joint.

2. The electronic article surveillance tag of claim 1, wherein:

said electronic article surveillance electronics comprise a passive electronic article surveillance element.

3. The electronic article surveillance tag of claim 2, wherein:

said passive electronic article surveillance element is a core and coil element.

4. The electronic article surveillance tag of claim 1, wherein:

said electronic article surveillance electronics comprise a microprocessor, onboard energy supply, and wireless communication elements.

5. The electronic article surveillance tag of claim 4, wherein:

said wireless communication elements comprise radio frequency transmitting and receiving circuitry.

6. The electronic article surveillance tag of claim 1, wherein:

said retention mechanism is magnetically releasable.

7. The electronic article surveillance tag of claim 1, wherein:

said retention mechanism is a ball clutch mechanism.

8. The electronic article surveillance tag of claim 1, wherein:

said attaching element comprises a lanyard having a first end and a second end, said first end of said lanyard terminating in said shaft, said second end of said lanyard terminating in a connector for forming a loop in said lanyard.

9. The electronic article surveillance tag of claim 8, wherein:

said connector is an eyelet sufficiently large enough for said first end of said lanyard to be inserted through said eyelet.

10. The electronic article surveillance tag of claim 1, wherein:

said attaching element comprises a lanyard having a first end and a second end, said first end of said lanyard terminating in said shaft, said second end of said lanyard being fixed to either said first pod or said second pod.

11. The electronic article surveillance tag of claim 1, wherein:

said attaching element comprises a cap on said shaft.

12. The electronic article surveillance tag of claim 1, wherein:

said articulating joint is a pivoting joint.

13. An electronic article surveillance tag comprising:

an articulating body and an attaching element, said articulating body comprising a first portion and a second portion;

said first portion of said articulating body enclosing electronic article surveillance electronics, and said second portion of said articulating body enclosing a retention mechanism, said second portion of said articulating body having an aperture allowing access to said retention mechanism; and, said attaching element having a shaft sized to be inserted through said aperture in said second portion into said retention mechanism to be retained by said retention mechanism.

14. The electronic article surveillance tag of claim 13, wherein:

said electronic article surveillance electronics comprise a passive electronic article surveillance element.

15. The electronic article surveillance tag of claim 13, wherein:

said passive electronic article surveillance element is a core and coil element.

16. The electronic article surveillance tag of claim 13, wherein:

said electronic article surveillance electronics comprise a microprocessor, onboard energy supply, and wireless communication elements.

17. The electronic article surveillance tag of claim 16, wherein:

said wireless communication elements comprise radio frequency transmitting and receiving circuitry.

18. The electronic article surveillance tag of claim 13, wherein:

said retention mechanism is magnetically releasable.

19. The electronic article surveillance tag of claim 13, wherein:

said retention mechanism is a ball clutch mechanism.

20. The electronic article surveillance tag of claim 13, wherein:

said attaching element comprises a lanyard having a first end and a second end, said first end of said lanyard terminating in said shaft, said second end of said lanyard terminating in a connector for forming a loop in said lanyard.

21. The electronic article surveillance tag of claim 20, wherein:

said connector is an eyelet sufficiently large enough for said first end of said lanyard to be inserted through said eyelet.

22. The electronic article surveillance tag of claim 13, wherein:

said attaching element comprises a lanyard having a first end and a second end, said first end of said lanyard terminating in said shaft, said second end of said lanyard being fixed to either said first pod or said second pod.

23. The electronic article surveillance tag of claim 13, wherein:

said attaching element comprises a cap on said shaft.

24. The electronic article surveillance tag of claim 13, wherein:

said second portion of said articulating body moves with respect to said first portion of said articulating body.

25. The electronic article surveillance tag of claim 24, wherein:

said second portion of said articulating body rotates with respect to said first portion of said articulating body.

* * * * *